US010764689B2

(12) United States Patent
Zhang

(10) Patent No.: US 10,764,689 B2
(45) **Date of Patent: *Sep. 1, 2020**

(54) SPEAKER

(71) Applicant: AAC Technologies Pte. Ltd., Singapore (SG)

(72) Inventor: Yong Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,573

(22) Filed: Jul. 30, 2019

(65) Prior Publication Data

US 2020/0045464 A1 Feb. 6, 2020

(30) Foreign Application Priority Data

Aug. 2, 2018 (CN) ..... 2018 2 1255928 U

(51) Int. Cl.

| | |
|---|---|
| ***H04R 9/02*** | (2006.01) |
| ***H04R 1/28*** | (2006.01) |
| ***H04R 9/06*** | (2006.01) |
| ***H04R 1/02*** | (2006.01) |

(52) U.S. Cl.

CPC ..... *H04R 9/06* (2013.01); *H04R 1/021* (2013.01); *H04R 1/025* (2013.01); *H04R 2400/11* (2013.01); *H04R 2499/11* (2013.01)

(58) Field of Classification Search

CPC ..... H04R 9/06; H04R 1/021; H04R 2400/11; H04R 2499/11

USPC ..... 381/332, 386, 90, FOR. 139

See application file for complete search history.

(56) References Cited

U.S. PATENT DOCUMENTS 10,433,037 B2 * 10/2019 Li ..... H04R 1/2853

FOREIGN PATENT DOCUMENTS

| | | | | |
|---|---|---|---|---|
| CN | 207070332 | * | 3/2018 | ..... H04R 9/02 |
| CN | 207460510 | * | 6/2018 | ..... H04R 9/06 |

* cited by examiner

*Primary Examiner* — Vivian C Chin
*Assistant Examiner* — Ubachukwu A Odunukwe
(74) *Attorney, Agent, or Firm* — W&G Law Group LLP

(57) ABSTRACT

A speaker includes a housing and a sound unit accommodated in the housing. A sound outlet is disposed on one side wall of the housing, a front cavity is formed between the sound unit and the housing, a front cavity channel and a side cavity on one side of the front cavity channel are disposed in the housing, and the front cavity channel is connected between the front cavity and the sound outlet. The speaker further includes a connecting channel formed by injection molding, and the connecting channel is connected between the side cavity and the front cavity channel. The connecting channel includes a bottom wall, a side wall which extends from the bottom wall, and a top wall connected to the side wall.

16 Claims, 3 Drawing Sheets

SPEAKER

TECHNICAL FIELD

The present disclosure relates to acoustic design technology, and particularly relates to a speaker.

BACKGROUND

In related technologies, a speaker includes a housing and a sound unit accommodated in the housing. A sound outlet is disposed on a side wall of the housing. A front cavity is formed between the sound unit and the housing. A front cavity channel and a side cavity on one side of the front cavity channel are disposed in the housing. The front cavity channel is connected between the front cavity and the sound outlet.

However, with respect to the speaker in the related technologies, if the sound unit is far away from the sound outlet, the front cavity channel is so long as to exceed a requirement for designing the front cavity. Generally, a cover plate is divided to add a smaller cavity on one side of the front cavity, in order to improve quality on audio high-frequency resonance. However, in this way, more parts are formed, assembling processes are complicated and an identical size of a channel between the two cavities is not guaranteed.

DETAILED DESCRIPTION

The present disclosure is described in detail below with reference to FIGS. 1 to 3.

Figure 1:
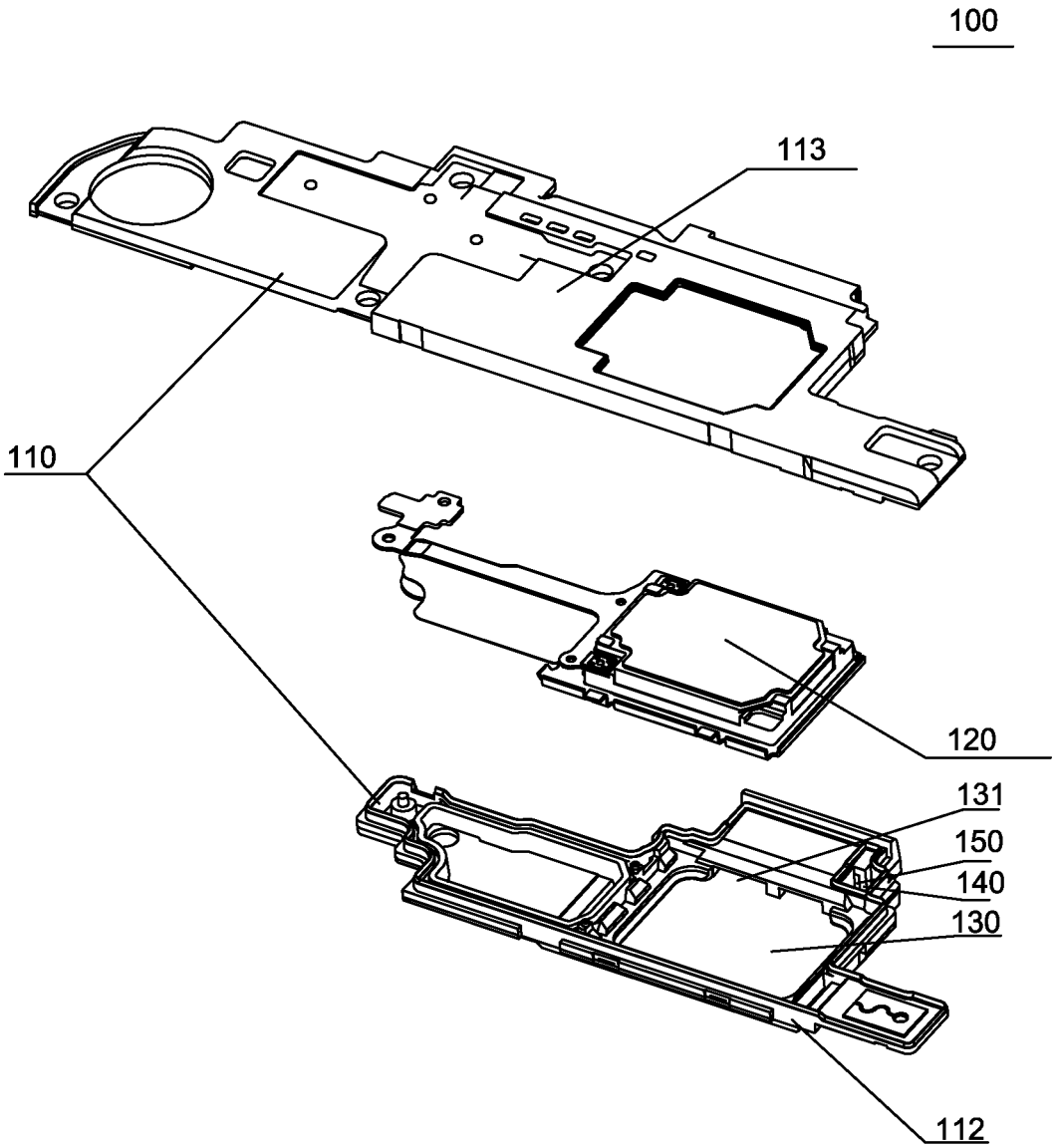
FIG. 1 is an exploded view of a speaker in the present disclosure.
Figure 2:
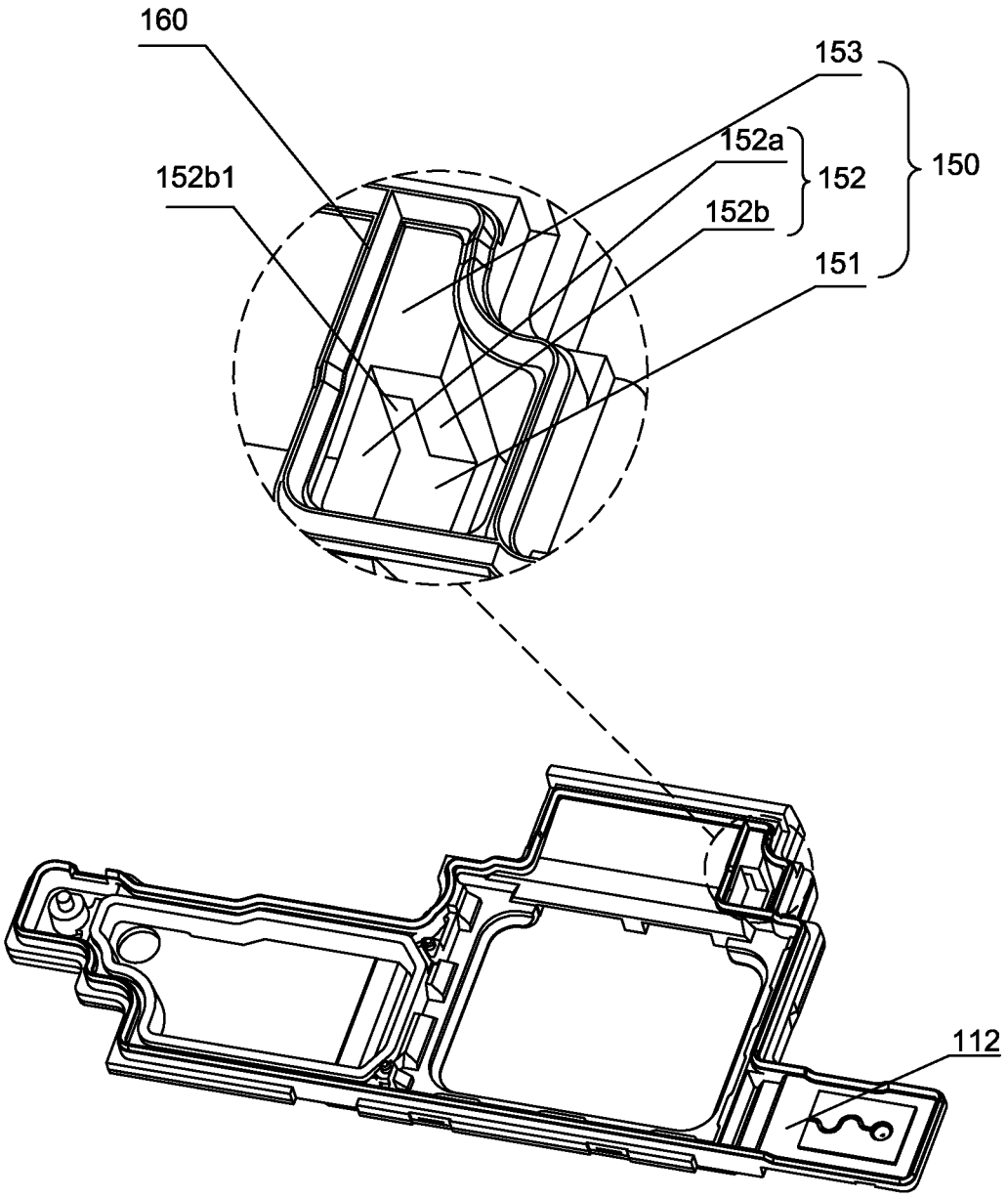
FIG. 2 is a schematic structural view of a first cover plate of the speaker in the present disclosure.
Figure 3:
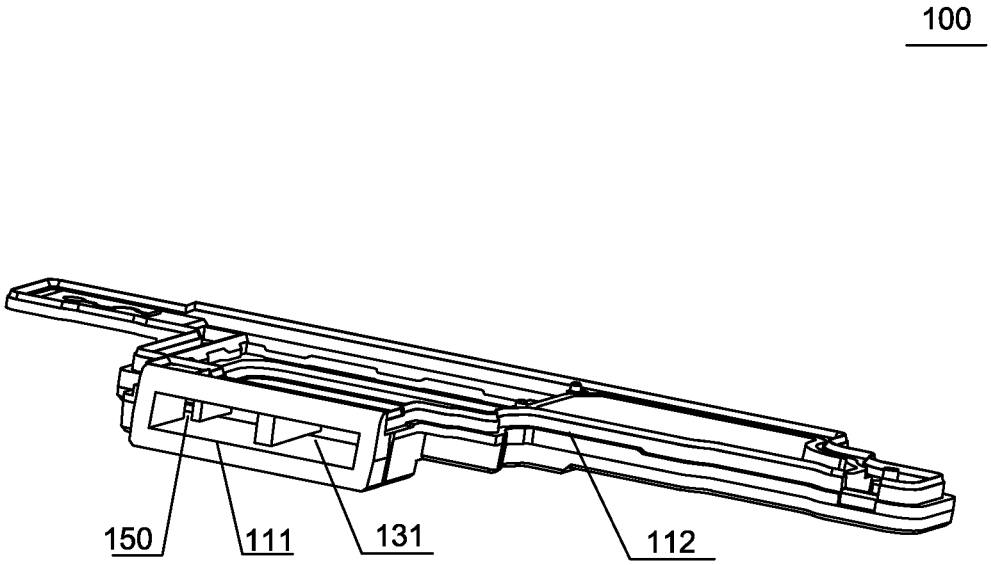
FIG. 3 is a schematic structural view of a first cover plate of the speaker in the present disclosure.

As shown in FIGS. 1 to 3, the present disclosure relates to a speaker 100 which includes a housing 110 and a sound unit 120 accommodated in the housing 110. A sound outlet 111 is disposed on one side wall of the housing 110. A front cavity 130 is formed between the sound unit 120 and the housing 110. A front cavity channel 131 and a side cavity 140 on one side of the front cavity channel 131 are disposed in the housing 110. The front cavity channel 131 is connected between the front cavity 130 and the sound outlet 111. The speaker 100 further includes a connecting channel 150 which is formed by injection molding. The connecting channel 150 is connected between the side cavity 140 and the front cavity channel 131. The connecting channel 150 includes a bottom wall 150, a side wall 152 which is formed by extending the bottom wall 150 towards the sound unit 120, and a top wall 153 which is connected to the side wall 152.

With respect to the speaker 100 with a structure of this embodiment, the front cavity channel 131 and the side cavity 140 on one side of the front cavity channel 131 are disposed in the housing. The front cavity channel 131 is connected between the front cavity 130 and the sound outlet 111. The speaker 100 further includes the connecting channel 150 formed by injection molding. The connecting channel 150 is connected between the side cavity 140 and the front cavity channel 131. The connecting channel 150 includes the bottom wall 150, the side wall 152 which extends from the bottom wall 151, and the top wall 153 which is connected to the side wall 152. In this way, the connecting channel 150 is formed by injection molding to effectively simplify complexity of a mold and effectively simplify assembling processes. In addition, the mold's stable molding may guarantee an identical size of the connecting channel 150, so that interchangeability therebetween may be improved, thereby effectively reducing cost for manufacturing the speaker 100. Further, the disposed side cavity 100 may effectively improve quality on audio high-frequency resonance and acoustic performance of the speaker 100.

It should be noted that what type of injection molding to form the connecting channel 150 is not defined. For example, a kissing-off position may be added on one side of the front cavity channel 131. The connecting channel 150 may be injection-molded through kissing-off between a mold slider and a mold core. Of course, in addition to this, other injection molding methods may be used.

As shown in FIGS. 1 and 2, the side wall 152 includes a first side wall 152*a* and a second side wall 152*b* adjacent to the first side wall 152*a*. The top wall 153 is connected to the second side wall 152*b* with a through hole 152*b*1 through an entire thickness of the second side wall, and the through hole 152*b*1 is connected between the side cavity 140 and the front cavity channel 131.

As shown in FIGS. 1 and 2, the bottom wall 151, the first side wall 152*a* and the second side wall 152*b* are located in the side cavity 140. The top wall 153 is flush with an upper surface of the front cavity channel 131.

As shown in FIG. 1, the housing 110 includes a first cover plate 112 and a second cover plate 113 that are disposed opposite to each other, and the front cavity 130 is formed between the first cover plate 112 and the sound unit 120. The front cavity channel 131 and the side cavity 140 are disposed in the first cover plate 112. The first cover plate 112 is disposed with a welding rib 160 around the side cavity 140. When the first cover plate 112 and the second cover plate 113 are closed together, the side cavity 140 is connected with the front cavity channel 131 only through the connecting channel 150.

The above-described are only embodiments of the present disclosure. It should be noted that skilled person in the art may make improvements without departing from the concept of the present disclosure. All these improvements fall into the protection scope of the present disclosure.

What is claimed is:

1. A speaker, comprising a housing and a sound unit accommodated in the housing, wherein a sound outlet is disposed on one side wall of the housing, a front cavity is formed between the sound unit and the housing, a front cavity channel and a side cavity on one side of the front cavity channel are disposed in the housing, and the front cavity channel is connected between the front cavity and the sound outlet, wherein the speaker further comprises a connecting channel formed by injection molding, the connecting channel is connected between the side cavity and the front cavity channel, and the connecting channel comprises a bottom wall, a side wall extending from the bottom wall, and a top wall connected to the side wall.

2. The speaker according to claim 1, wherein the side wall comprises a first side wall and a second side wall adjacent to the first side wall, the top wall is connected to the second side wall with a through hole through an entire thickness of the second side wall, and the through hole is connected between the side cavity and the front cavity channel.

3. The speaker according to claim 1, wherein the housing comprises a first cover plate and a second cover plate that are disposed opposite to each other, and the front cavity is formed between the first cover plate and the sound unit.

4. The speaker according to claim 2, wherein the bottom wall, the first side wall and the second side wall are located in the side cavity.

5. The speaker according to claim 4, wherein the housing comprises a first cover plate and a second cover plate that are disposed opposite to each other, and the front cavity is formed between the first cover plate and the sound unit.

6. The speaker according to claim 5, wherein the front cavity channel and the side cavity are disposed in the first cover plate.

7. The speaker according to claim 6, wherein the first cover plate is disposed with a welding rib around the side cavity.

8. The speaker according to claim 2, wherein the top wall is flush with an upper surface of the front cavity channel.

9. The speaker according to claim 8, wherein the housing comprises a first cover plate and a second cover plate that are disposed opposite to each other, and the front cavity is formed between the first cover plate and the sound unit.

10. The speaker according to claim 9, wherein the front cavity channel and the side cavity are disposed in the first cover plate.

11. The speaker according to claim 10, wherein the first cover plate is disposed with a welding rib around the side cavity.

12. The speaker according to claim 2, wherein the housing comprises a first cover plate and a second cover plate that are disposed opposite to each other, and the front cavity is formed between the first cover plate and the sound unit.

13. The speaker according to claim 12, wherein the front cavity channel and the side cavity are disposed in the first cover plate.

14. The speaker according to claim 13, wherein the first cover plate is disposed with a welding rib around the side cavity.

15. The speaker according to claim 3, wherein the front cavity channel and the side cavity are disposed in the first cover plate.

16. The speaker according to claim 15, wherein the first cover plate is disposed with a welding rib around the side cavity.

* * * * *